US005221141A

United States Patent [19]

Swanson

[11] Patent Number: 5,221,141

[45] Date of Patent: Jun. 22, 1993

[54] STAND-ALONE ELECTRIC LAMP

[75] Inventor: Dennis K. Swanson, Woodland Hills, Calif.

[73] Assignee: Lamps Plus, Inc., Chatsworth, Calif.

[21] Appl. No.: 863,630

[22] Filed: Apr. 6, 1992

[51] Int. Cl.[5] ..... F21S 1/12

[52] U.S. Cl. ..... 362/250; 362/410; 362/414; 362/418

[58] Field of Search ..... 362/236, 242, 243, 249, 362/250, 251, 410, 414, 418, 419, 421, 431, 127, 223, 348, 241, 247, 413

[56] References Cited

U.S. PATENT DOCUMENTS

| | | | |
|---|---|---|---|
| 1,802,460 | 4/1931 | Doane | 362/414 |
| 1,966,485 | 7/1934 | Chanock | 362/414 |
| 2,965,751 | 12/1960 | Stiffel | 362/431 |
| 2,977,566 | 3/1961 | Neumann et al. | 362/431 |
| 3,278,203 | 10/1966 | Snyder | 362/421 |
| 3,997,776 | 12/1976 | Ruud | 362/127 |
| 4,428,036 | 1/1984 | Letcher | 362/348 |
| 4,974,137 | 11/1990 | Evans Jr. et al. | 362/348 |
| 5,016,154 | 5/1991 | Leeyeh | 362/431 |

OTHER PUBLICATIONS

"Spotlight from Floor Lamp Illuminates Reading", Popular Mechanics, p. 716, Apr. 1941.

*Primary Examiner*—Richard R. Cole

*Attorney, Agent, or Firm*—Robbins, Dalgarn, Berliner & Carson

[57] ABSTRACT

A stand-alone electric lamp which includes a base and a general area light source affixed to opposite ends of a stem to provide general area lighting. Disposed on the stem intermediate the base and the general area light source are a plurality of light sources for providing task lighting directable to specific areas. Each of the general area and task lights are individually controllable. Each of the task lights is adjustable universally to enable directing the light therefrom to the desired area.

8 Claims, 2 Drawing Sheets

STAND-ALONE ELECTRIC LAMP

BACKGROUND OF THE INVENTION

1. Field of the Invention

The present invention relates generally to electric lighting apparatus and more particularly to a stand-alone electric lamp which includes the combination of general area lighting and task lighting on the same structure.

2. Prior Art

Electric lighting apparatus in the form of floor lamps and table lamps is well known. Such lamps generally take the form of a general area lighting device or alternatively, a task lighting device. A general lighting apparatus is one which provides lighting for a predetermined area without particular concern for directing the light for reading, highlighting specific, items such as paintings or the like or otherwise. On the other hand, task lighting focuses the light through the utilization of reflectors for use for a specific purpose such as reading, to highlight a given area, to accent some item such as a sculpture, painting or the like. An example of task lighting structures are the well known pole lamps or track lighting structures.

While the prior art general area lighting devices and task lighting devices have functioned quite well for the specific purposes intended, Applicant is unaware of any prior art which combines both general area lighting and task lighting into a single stand-alone electric lamp apparatus.

SUMMARY OF THE INVENTION

A stand-alone electric lamp which includes a base member for supporting the same, an elongated hollow stem rising centrally from the base member, and a general area lighting means carried by the opposite end of the stem. A plurality of separate direct light reflectors are affixed to the stem at spaced apart positions disposed between the base and the general area lighting means. Electrical wiring is disposed within the hollow stem and is combined with switch means for individually controlling the application of electrical energy to each of the general area lighting means and the plurality of separate direct light reflectors.

DETAILED DESCRIPTION

Figure 1:
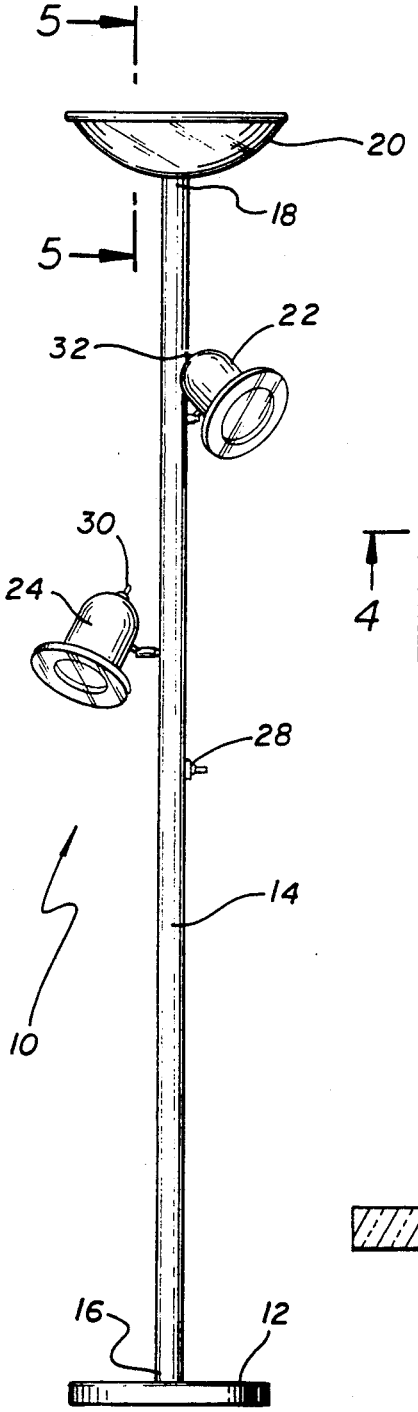
FIG. 1 is a perspective view illustrating a stand-alone electric lamp constructed in accordance with the principals of the present invention.

As illustrated in the drawings and more particularly in FIG. 1, there is provided a stand-alone lamp 10 having a base 12 from which extends a hollow stem 14. The stem has a first end 16 which is rigidly and permanently affixed to the base 12 at approximately the center thereof. A second end 18 of the stem 14 is affixed to a general area lighting means 20 with the stem 14 being permanently affixed thereto at approximately the central portion thereof. Disposed between the base 12 and the general area lighting means 20 are a plurality of task lighting means such as task lights as illustrated at 22 and 24. Although only two task lights 22 and 24 are illustrated in FIG. 1, it should be understood by those skilled in the art that any number of task lights may be utilized as desired depending upon the particular application to which the stand-alone lamp is to be placed. Such multiplicity of task lights may be utilized for more specific applications such as reading or accent lighting of various items such as painting, sculptures or the like as may be desired.

Electrical wiring 26 extends through the hollow stem 14 and provides electrical energy to lamps which are disposed within the general purpose lighting means 20 as well as the task lighting means 22 and 24. Switch means 28, 30 and 32 are provided to individually control the application of electrical energy to the lighting sources disposed within the lighting means 20, 22, and 24. The switch 28 is utilized to control the light source in the general purpose lighting means 20 and functions as a stem-mounted full dimmer switch which can turn the lamp in the general purpose lighting means 20 off and on as well as from full dim to full bright. The switches 30 and 32 are utilized to turn the light sources contained within the task lights 22 and 24 on or off and, alternatively, also may be two-way, three-way, or dimmer switches if such is desired.

Figure 2:
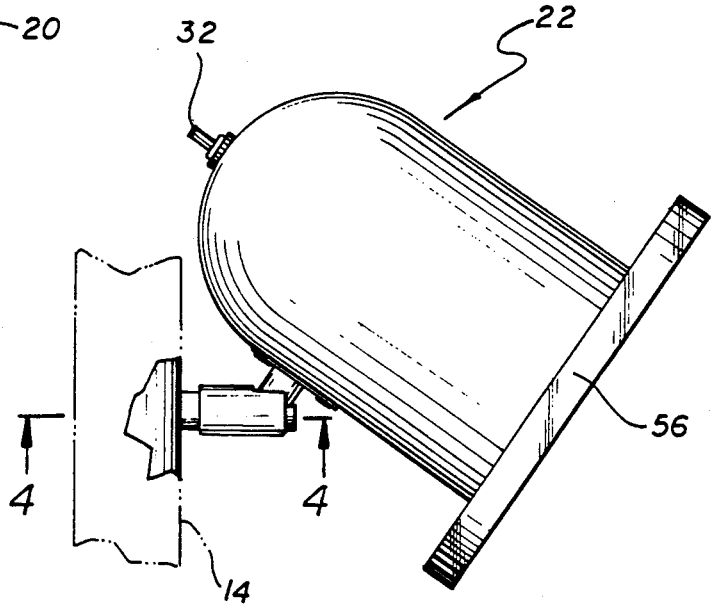
FIG. 2 is a fragmentary perspective view illustrating in more detail one of the plurality of task lights forming a part of the lamp as illustrated in FIG. 1.
Figure 3:
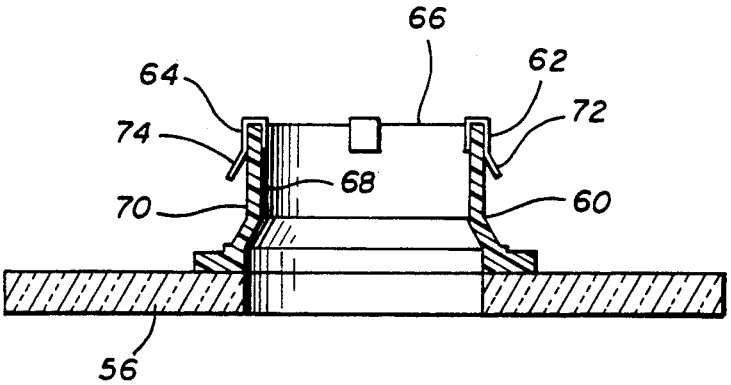
FIG. 3 is a cross-sectional view illustrating a detachable rim which forms a part of the task light as illustrated in FIG. 2.
Figure 4:
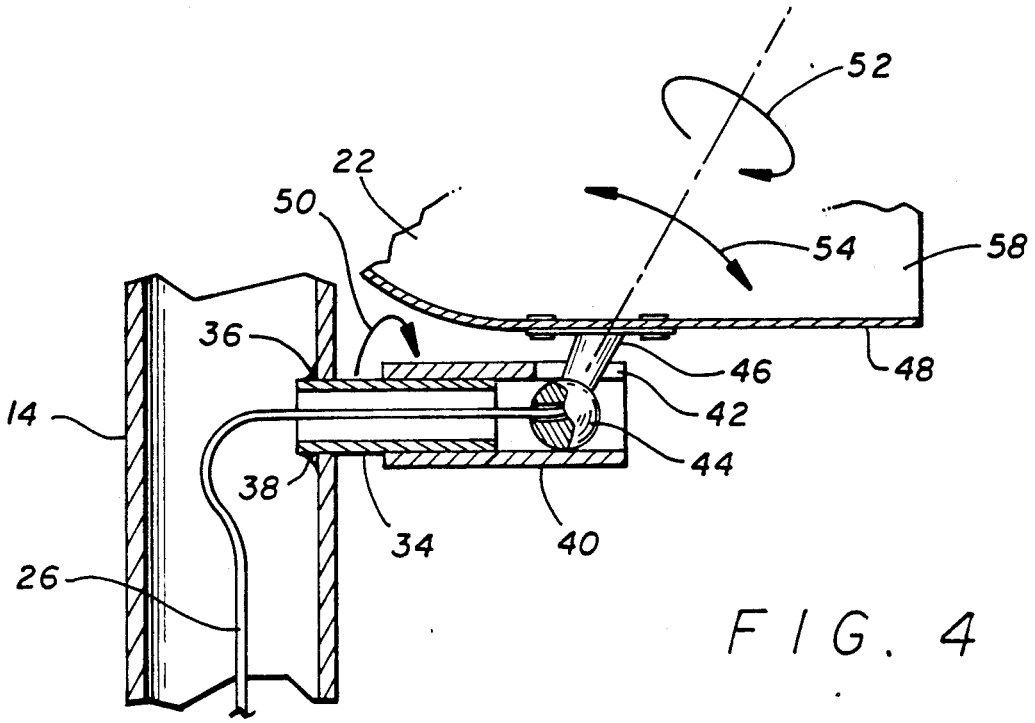
FIG. 4 is a fragmentary cross-sectional view taken about the lines 4—4 of FIG. 2 illustrating the adjustability of the task light.

As shown more specifically in FIGS. 2, 3, and 4, a typical task light 22 is adjustably affixed to the stem 14 by means of a stand off 34 which has one end 36 affixed to the stem 14 by any type of fastening means 38 desired as is well known to those skilled in the art. Rotatably coupled to the stand off 34 is a hollow cylinder 40 having an opening 42 in the wall thereof. The opening 42 receives a ball 44 which is formed on a protrusion 46 which is affixed to the outer surface 48 of the lamp 22. The electrical wires 26 extend internally of the hollow stem 14 and pass through the stand off 34 and the ball 44 and into the interior of the lamp 22 to energize a light source (not shown) contained therein. The hollow cylinder 40 may be rotated as illustrated by the arrow 50 while the lamp 22 may be rotated about the axis of the protrusion 46 as shown by the arrow 52 as well as being movable in an oscillating fashion as illustrated by the arrow 54. The movements provided by the coupling of the lamp 22 to the stem 14 effectively provides a universal adjustability of the task light 22 to direct its light to any position desired for any particular application.

The task lights may include a detachable rim 56 which is secured in place within the interior 58 of the lamp 22. As is shown more specifically in FIG. 3, the rim 56 may be constructed of clear or colored plastic material, such as acrylic, and is affixed to a hollow cylinder 60 in any manner desired such as by fasteners, adhesives or the like (not shown). Preferably the cylinder 60 is constructed of a molded plastic material such as acrylic, polyethylene or the like. A plurality of metallic clips 62 and 64 are pushed over the edge 66 of the cylinder 60 and are held in place by friction against the inner and outer surfaces 68 and 70 of the cylinder 60. The outer arm of the clips 62 and 64 are bent outwardly as shown at 72 and 74 so that when inserted into the inner portion 58 (FIG. 4) of the task light 22 and 24, the outwardly directed portions 72 and 74 will be compressed inwardly to conform to the inner surfaces of the housing of the task light 22 and through the forces provided by the clip spring material will securely hold the rim 56 in place thereon. It will be readily recognized by those skilled in the art that the rim 56 may be easily removed from the task lights if such is desired so that the task light may be used without the rim as is illustrated in FIG. 4.

Figure 5:
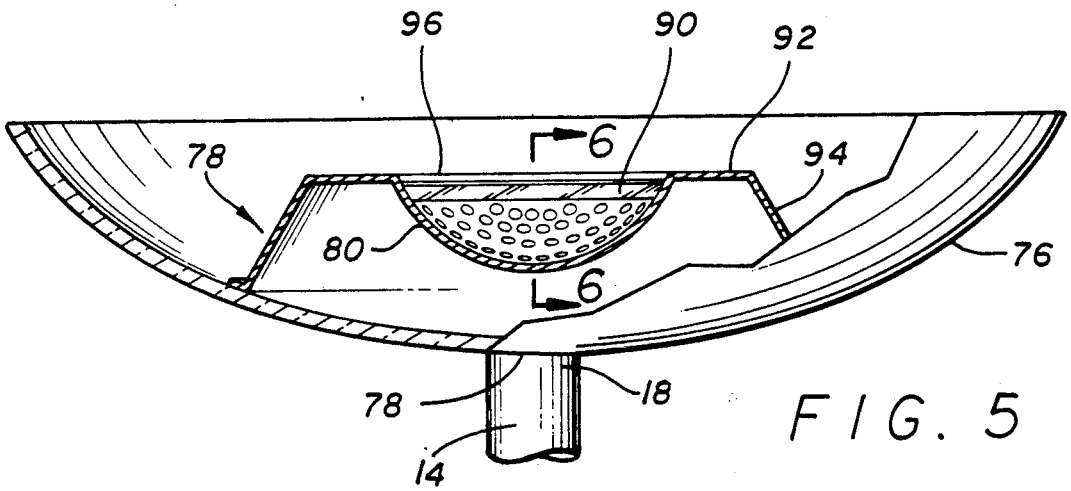
FIG. 5 is a cross-sectional view of the general area lighting portion of the lamp as illustrated in FIG. 1 taken about the lines 5—5 thereof.
Figure 6:
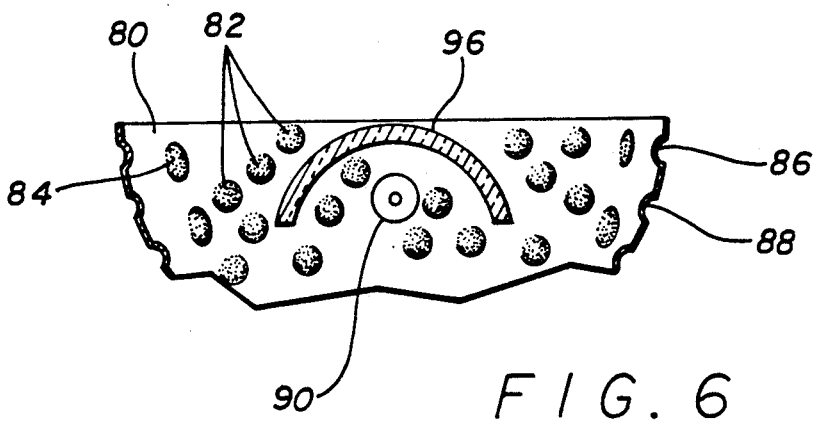
FIG. 6 is a fragmentary cross-sectional view taken about the line 6—6 of FIG. 5 illustrating the halogen lamp in its protective cover.

As is illustrated more specifically in FIGS. 5 and 6, the general purpose lighting means may include an upwardly directed bowl or pan-shaped member 76 having a central portion thereof 78 affixed to the upper or second end 18 of the hollow stem 14. Disposed internally of the pan 76 is a reflector 78 having a concave surface 80 which has a plurality of bump-like protrusions 82 formed on the inner surface thereof. As is illustrated more specifically in FIG. 6, each of the protrusions includes a textured or non-polished surface 84. The bumps 82 as well as the textured surface 84 may be formed at the time of manufacture of the concave surface 80 by application of a textured die or the like which forms the bumps by directing the surface 80 inwardly (toward the light source) as is illustrated at 86 and 88 of FIG. 6. Obviously, the dies may have a textured surface to form the texture 84 on the bumps 82.

The utilization of the bumps 82 which are randomly disposed about the surface 80 is to prevent the light which emanates from a halogen light source 90 from forming a particular pattern upon a surface such as the ceiling which is disposed adjacent the opening of the pan 76.

As is illustrated, the surface 80 is supported by a planar lip 92 which includes a downwardly turned wall 94 which in turn is affixed to the inner surface of the pan 76 in any manner desired as will be readily recognized by those skilled in the art. The lip 92 includes means for receiving the halogen light source 90 and also for supporting a protective shield 96 which is utilized to preclude portions of the halogen light 90 from being disbursed into the surrounding area should the halogen light explode, which has been known to occur.

Although the stand-alone lamp including the general area lighting means as well as the task lighting means is illustrated particularly in FIG. 1 as a torchiere lamp wherein the base 12 and the pan 20 are of substantially the same diameter, it should be recognized by those skilled in the art that the stand-alone lamp may take the form of a standard type floor lamp or table lamp having the usual fluorescent or incandescent lamp bulb and shade but with the plurality of task lights extending from the stem to thus provide the stand-alone lamp as described herein.

The present invention has been described in its preferred embodiment as is illustrated in the accompanying drawings. However, it should be understood that the invention is not limited by such description and illustration but rather is measured by the scope of the claims appended hereto.

What is claimed:

1. A stand-alone electric lamp comprising:

a base member for supporting said lamp;

an elongated hollow stem having first and second ends, said first end connected to said base member, said stem rising centrally from said base member;

general area lighting means carried by said second end of said stem;

a plurality of separate direct light reflectors affixed to said stem at spaced apart positions disposed between said base and said general area lighting means;

a detachable rim carried by each of said separate light reflectors;

electrical wiring means disposed within said hollow stem for providing electrical energy to lamps disposed within sad reflectors and said general area lighting means; and switch means for individually controlling the application of electrical energy to each of said lamps.

2. A stand-alone lamp as defined in claim 1 wherein said detachable rim includes a hollow cylinder affixed to said rim, said cylinder being attached to said separate light reflector.

3. A stand-alone lamp as defined in claim 2 which further includes a plurality of metallic clips secured to said cylinder, each said clip having an outwardly directed arm for engaging said separate light reflector to attach said rim to said separate light reflector.

4. A stand-alone electric lamp comprising:

a base member for supporting said lamp;

an elongated hollow stem having first and second ends, said first end connected to said base member, said stem rising centrally from said base member;

general area lighting means rigidly affixed to said second end of said stem, said general area lighting means including an upwardly directed bowl-shaped member having a diameter at least as large as that of said base, said bowl member including a first light reflector disposed to direct light in an upward direction away from said base member;

said first light reflector including a concave surface having a plurality of bumps distributed in a random fashion thereover for effecting a non-patterned distribution of light from said reflector, each of said bumps including a textured surface;

a plurality of separate direct light reflectors affixed to said stem at spaced apart positions disposed between said base and said general area lighting means;

electrical wiring means disposed within said hollow stem for providing electrical energy to lamps disposed within said direct light reflectors and said general area lighting means; and switch means for individually controlling the application of electrical energy to each of said lamps.

5. A stand-alone electric lamp comprising:

a base member for supporting said lamp;

an elongated hollow stem having first and second ends, said first end connected to said base member, said stem rising centrally from said base member;

general area lighting means carried by said second end of said stem;

a plurality of separate direct light reflectors;

means for affixing each of sad separate direct light reflectors to said stem at spaced apart positions disposed between said base and said general area lighting means;

said means for affixing each separate direct light reflector including:

(a) a first hollow cylinder affixed to and extending from said stem;

(b) a second hollow cylinder defining a through opening in a wall thereof rotatably affixed to said first hollow cylinder;

(c) a protrusion extending from said light reflector, and (d) said protrusion being received within said second hollow cylinder and extending through said opening in said wall;

electrical wiring means disposed within said hollow stem for providing electrical energy to lamps disposed within said reflectors and said general area lighting means; and switch means for individually controlling the application of electrical energy to each of said lamps.

6. A stand-alone lamp as defined in claim 5, wherein said general area lighting means includes an upwardly directed bowl shaped member, a concave light reflector terminating in a planar rim the periphery of which has a downwardly directed wall affixed to said bowl shaped member, and a light source carried by said planar rim.

7. A stand-alone lamp as defined in claim 6 wherein said switch means includes a switch mounted on said stem for controlling said general area lighting means.

8. A stand-alone lamp as defined in claim 7 which further includes a separate switch mounted on each of said separate direct light reflectors.

* * * * *